US005359400A

United States Patent [19]

Itoh et al.

[11] Patent Number: 5,359,400

[45] Date of Patent: Oct. 25, 1994

[54] IMAGE FORMING APPARATUS

[75] Inventors: Toshiyuki Itoh, Toride; Junichi Kimizuka, Yokohama; Takeji Gima, Toride, all of Japan

[73] Assignee: Canon Kabushiki Kaisha, Tokyo, Japan

[21] Appl. No.: 988,906

[22] Filed: Dec. 10, 1992

[30] Foreign Application Priority Data

Dec. 12, 1991 [JP] Japan ..... 3-350643

[51] Int. Cl.[5] ..... G03G 21/00

[52] U.S. Cl. ..... 355/285; 219/216; 355/203; 355/208; 355/289

[58] Field of Search ..... 355/208, 204, 203, 285, 355/282, 289, 286, 291, 205, 206, 290; 219/216

[56] References Cited

U.S. PATENT DOCUMENTS

| | | | |
|---|---|---|---|
| 4,998,121 | 3/1991 | Koh et al. | 346/160 |
| 5,023,631 | 6/1991 | Negishi et al. | 355/206 X |
| 5,026,276 | 6/1991 | Hirabayashi et al. | 355/282 X |
| 5,105,219 | 4/1992 | Yoshikado | 355/206 |
| 5,162,848 | 11/1992 | Saitoh et al. | 355/206 |
| 5,171,145 | 12/1992 | Kusaka et al. | 355/286 X |

FOREIGN PATENT DOCUMENTS

| | | | |
|---|---|---|---|
| 0373654 | 6/1990 | European Pat. Off. | 355/285 |
| 0003686 | 1/1985 | Japan | 355/285 |
| 0175069 | 9/1985 | Japan | 355/285 |
| 0043549 | 2/1990 | Japan | 355/285 |
| 0127682 | 5/1990 | Japan | 355/289 |
| 1416930 | 8/1988 | U.S.S.R. | 355/285 |

*Primary Examiner*—Matthew S. Smith

*Attorney, Agent, or Firm*—Fitzpatrick, Cella, Harper & Scinto

[57] ABSTRACT

The present invention provides an image forming apparatus with a sheet supply cassette which can contain a plurality of recording members and can be removably mounted within the image forming apparatus, an image forming device for forming an image on the recording member with toner to form a toner image, fixing rollers having a heater for thermally fixing the toner image on the recording member, remaining amount detecter means for detecting the remaining amount of the recording members in the sheet supply cassette or/and a remaining amount of the toner and generating a detection signal, and energization stopping control for stopping the energization of the heater on the basis of the detection signal.

7 Claims, 6 Drawing Sheets

| FIG. 3A | FIG. 3B |
|---|---|

IMAGE FORMING APPARATUS

BACKGROUND OF THE INVENTION

1. Field of the Invention

The present invention generally relates to an image forming apparatus such as an electrophotographic apparatus, electrostatic recording apparatus and the like, and more particularly it relates to an image forming apparatus having a thermal fixing device.

2. Related Background Art

Conventionally, thermal fixing devices, particularly fixing devices of heat roller type, have been widely used as fixing devices for image forming apparatus. A fixing device of heat roller type comprises a heat roller having a heater therein for maintaining a temperature of a surface of the heat roller at a predetermined fixing temperature and a pressure roller for cooperating with the heat roller to form a nip therebetween, and is designed so that, while a recording sheet on which a non-fixed toner image is born passes through the nip, the toner image is fixed to the recording sheet with heat and pressure.

The heater is energized at the same time when a main power source of the image forming apparatus is turned ON, and is disenergized when the main power source is turned OFF. Meanwhile, the surface temperature of the heat roller is adjusted to a predetermined fixing temperature or stand-by temperature.

Further, the image forming apparatus normally includes a removable sheet supply cassette. When the recording sheets in the cassette are used up, the image forming operation cannot be performed. In this case, an operator must remove the empty cassette from the image forming apparatus, and re-insert the cassette into the image forming apparatus after new recording sheets are loaded in the cassette. During this operation, the main power source is maintained to the ON condition to continuously energize the fixing heater.

The shock or vibration due to the mounting and dismounting of the sheet supply cassette sometimes acts on the image forming apparatus while the heater is being energized, causing the heater to be damaged or to deteriorate. Particularly, this may occur when a halogen lamp is used as the fixing heater. If the shock or vibration acts on the halogen lamp which is being energized, a tungsten coil in the halogen lamp will easily be deteriorated. Further, regarding the halogen lamp, since the outage of the tungsten coil is increased as the cumulative energizing time of the lamp is increased, when the halogen lamp is used as the fixing heater, the outage of the heater is increased.

Further, when the amount of toner remaining falls below a predetermined amount, the image forming operation cannot be effected either. If the shock or vibration due to the replenishment of toner acts on the image forming apparatus, the breakdown of the heater also sometimes occurs.

SUMMARY OF THE INVENTION

An object of the present invention is to provide an image forming apparatus which can prevent or eliminate the deterioration and break-down of a fixing heater.

Another object of the present invention is to provide an image forming apparatus wherein the loading of recording sheets and the replenishment of toner can be performed while the energization of the heater is stopped.

A further object of the present invention is to provide an image forming apparatus having energization stopping means for stopping the energization of a fixing heater on the basis of a detection output from remaining amount detection means for detecting a remaining amount of recording sheets in a sheet supply cassette.

A still further object of the present invention is to provide an image forming apparatus having energization stopping means for stopping the energizaton of a fixing heater on the basis of a detection output from remaining amount detection means for detecting a toner remaining amount.

The other objects of the present invention will be apparent from the following detailed explanation of the present invention.

DETAILED DESCRIPTION OF THE PREFERRED EMBODIMENTS

The present invention will now be explained in connection with an embodiment thereof.

Figure 1:
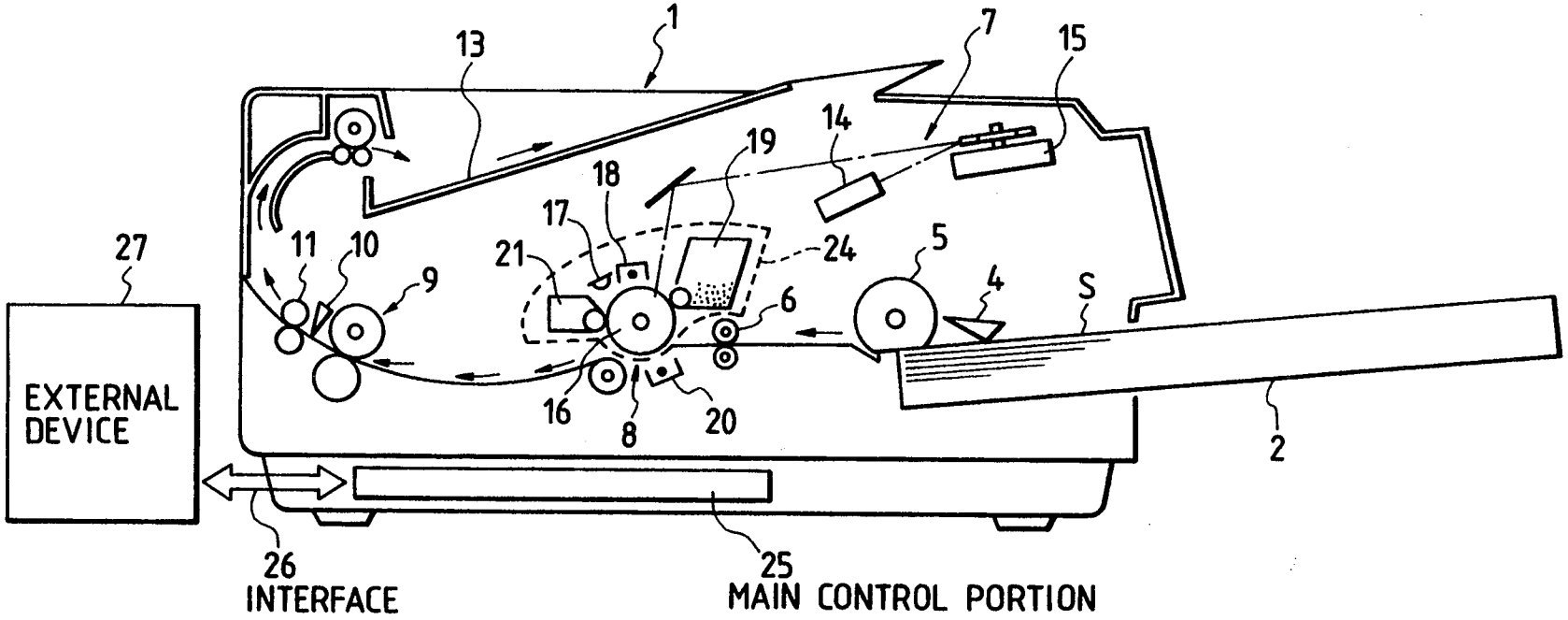
FIG. 1 is a schematic elevational sectional view of an image forming apparatus according to a preferred embodiment of the present invention.

FIG. 1 is a schematic elevational sectional view of an image forming apparatus according to a preferred embodiment of the present invention.

The image forming apparatus 1 includes a removable sheet supply cassette 2 containing therein transfer sheets S as recording members. The sheet supply cassette 2 has an actuator 4 for detecting the presence/absence of the transfer sheet S, which actuator 4 outputs a shifting amount corresponding to a remaining number of the transfer sheets S. The transfer sheet S in the sheet supply cassette 2 is fed out, by a sheet supply roller 5, toward a pair of register rollers 6. The register rollers 6 serve to feed the transfer sheet S toward a photosensitive drum 16 in such a manner that the feeding timing of the transfer sheet S is in registration with the rotation of the photosensitive drum.

An image 7 corresponding to an original image is exposed on the photosensitive drum 16 by a laser beam unit 14 via a polygon mirror 15. Around the photosensitive drum 16, there are arranged a pre-exposure lamp 17, a primary charger 18, a developer or developing device 19 and a cleaner 21. These elements 17 to 21 and the photosensitive drum 16 are integrally assembled as a process cartridge 24. The process cartridge 24 can be removably mounted within a main body of the image forming apparatus (referred to merely as "main body" hereinafter). A transfer charger 20 is disposed below the process cartridge 24.

Figure 5:
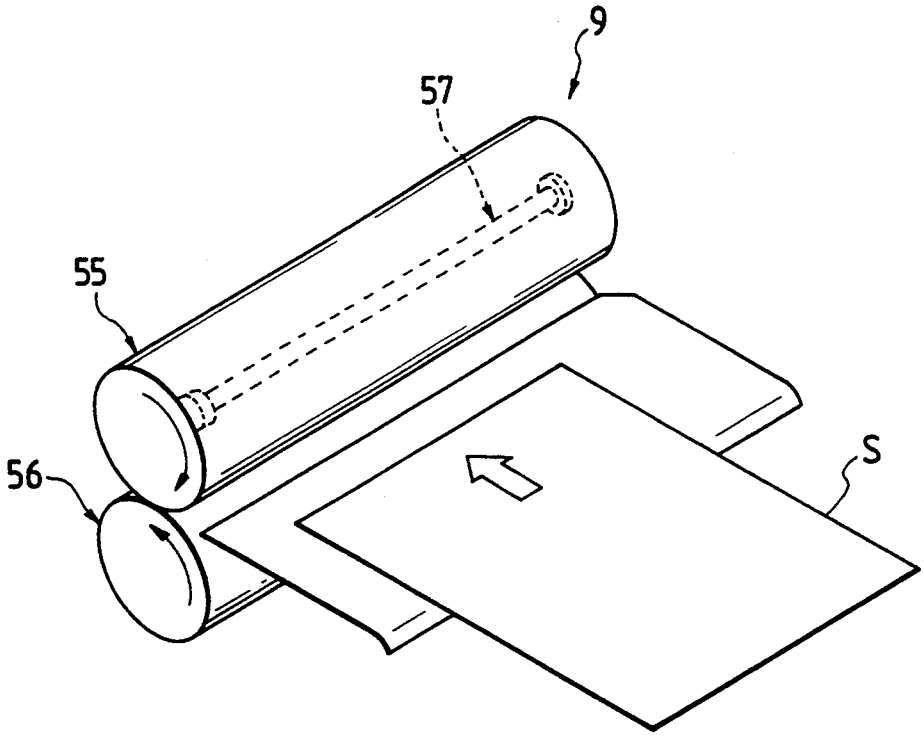
FIG. 5 is a perspective view of a fixing device used with the image forming apparatus of Fig. 1.

A visualized toner image on the photosensitive drum 16 is transferred onto the transfer sheet S fed from the register rollers 6, and then the transfer sheet S is sent to a fixing device 9. As shown in FIG. 5, the fixing device 9 comprises a fixing roller 55, and a pressure roller 56 urged against and rotatingly driven by the fixing roller 55. The fixing roller 55 and the pressure roller 56 cooperate with each other to form a nip therebetween for pinching and conveying the transfer sheet S. The fixing roller incorporates therein a fixing heater 57 for heating a surface of the fixing roller 55 to a pre-selected fixing temperature. The fixing heater 57 comprises a halogen lamp.

After the fixing operation, the transfer sheet S is discharged onto a discharge tray 13 by a pair of discharge rollers 11. Between the fixing device 9 and the discharge rollers 11, there is arranged a sheet discharge sensor 10 for detecting the presence/absence of the jamming of the sheet in the fixing device 9.

The above-mentioned various elements are controlled by the command from a main control portion 25 which is connected to an external device 27 via an interface 26.

Next, the control relationship between the main control portion 25 and the various elements will be explained with reference to FIGS. 1, 3, and 4.

Figures 3, 3A:
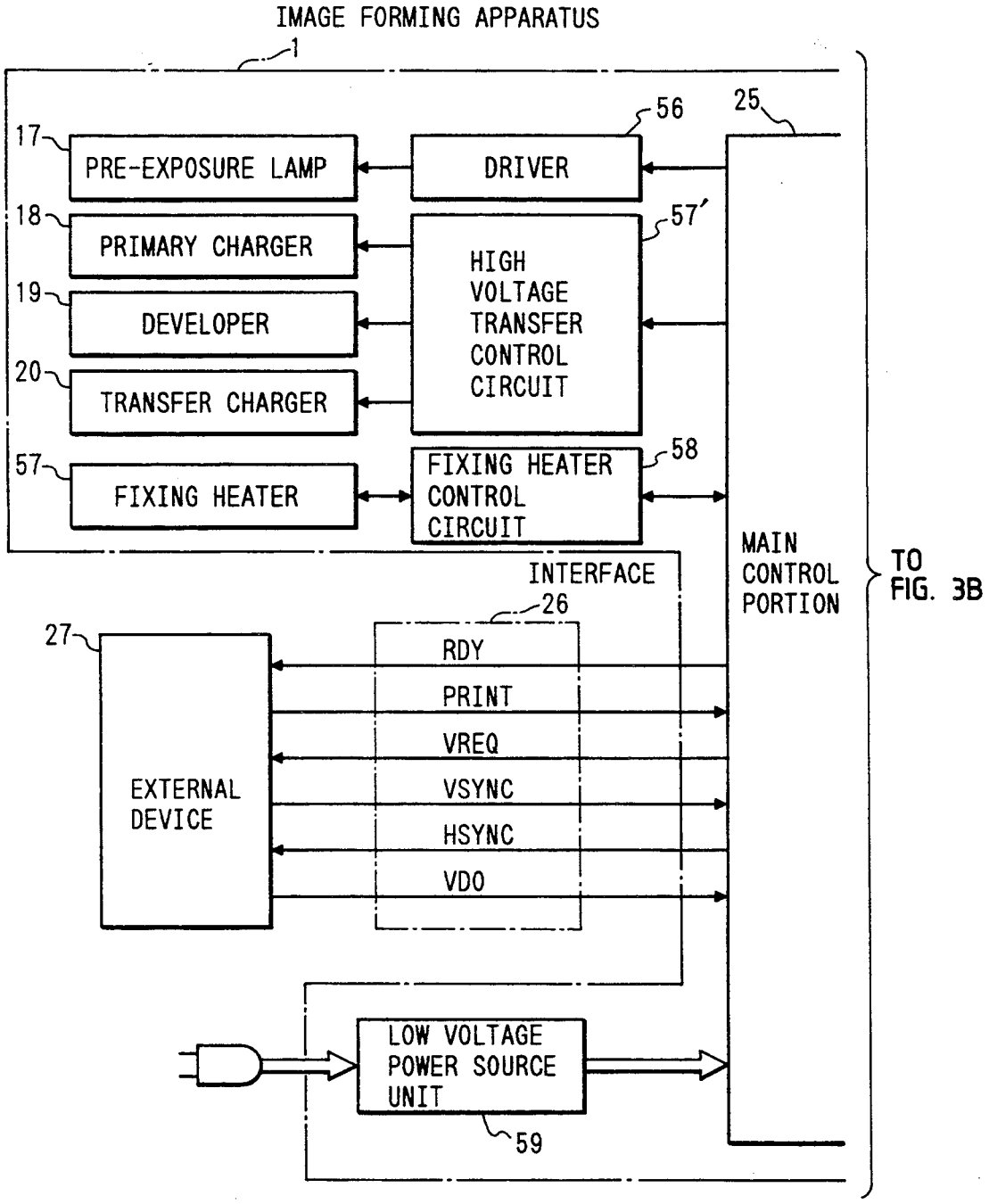
FIG. 3 is a fractional depiction of the overall device and is the combination of FIGS. 3*a* and 3*b* which are block diagrams showing the construction of the image forming apparatus.
Figure 3B:
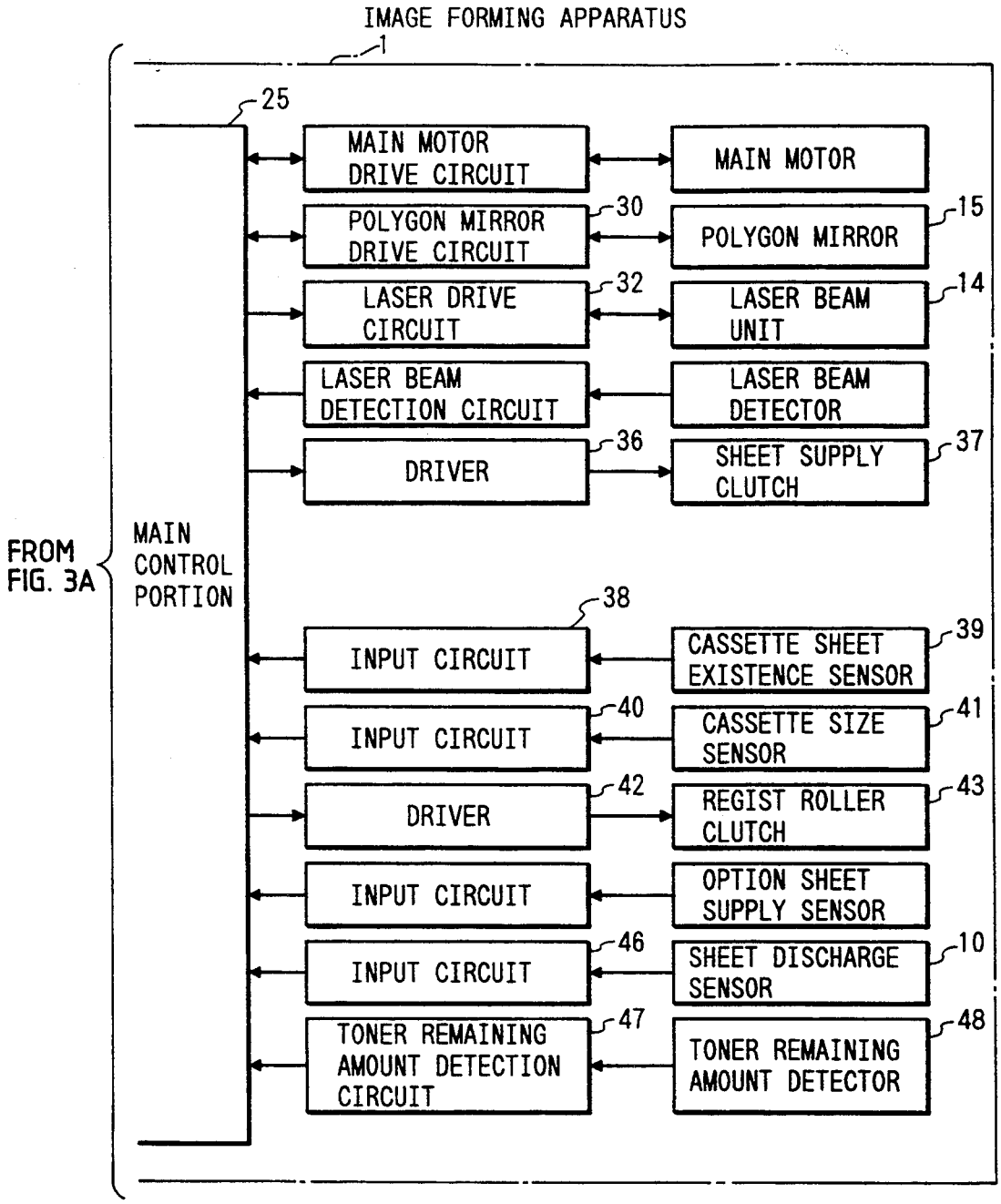
Figure 4:
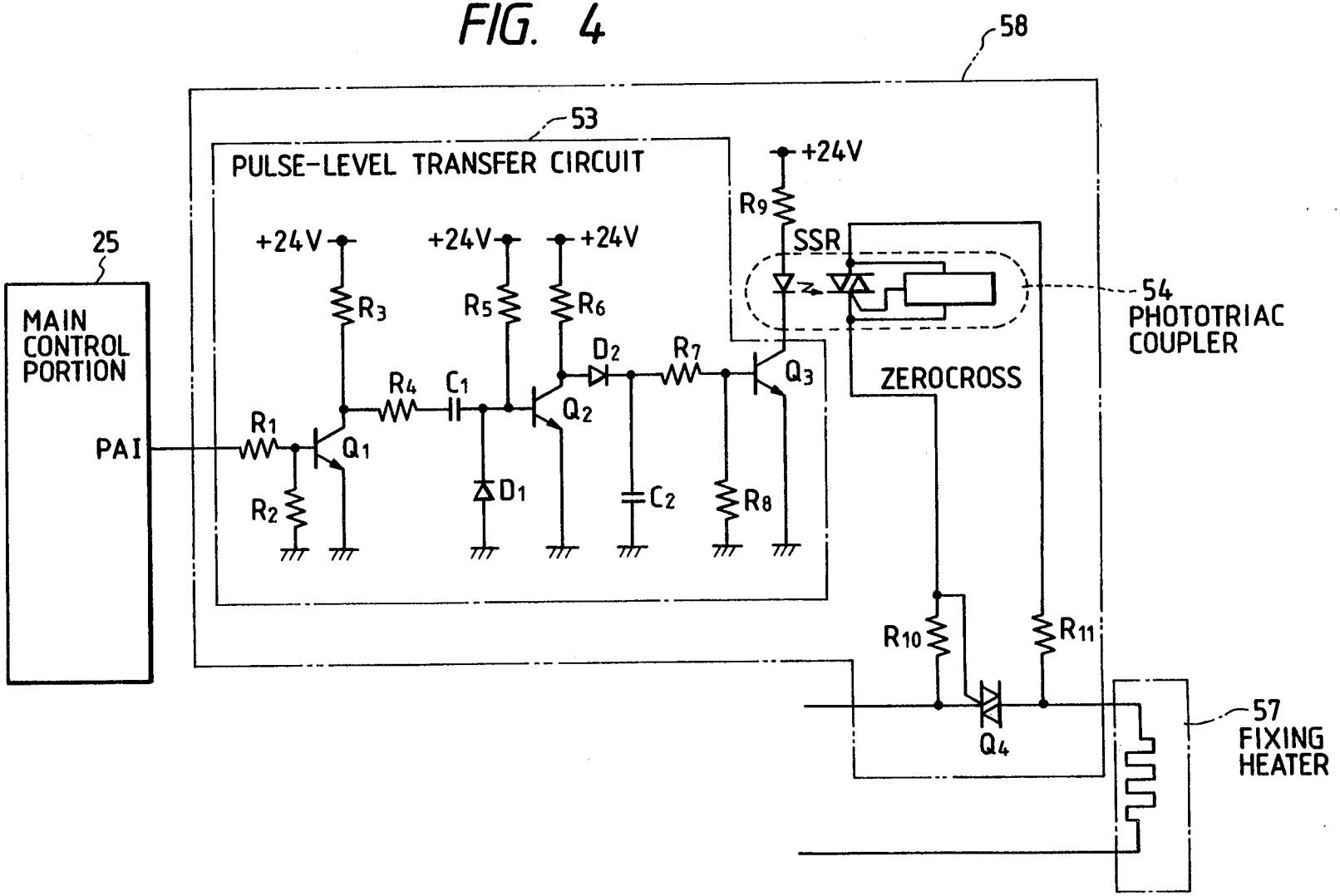
FIG. 4 is a fixing heater control circuit used with the image forming apparatus of FIG. 1.

As shown in FIGS. 1 and 3, the shifting amount of the actuator 4 of the sheet supply cassette 2 is inputted to a cassette sheet existence sensor 39 which in turn determines the presence/absence of the transfer sheet S on the basis of the shifting amount of the actuator 4 to output a signal representative of the presence/absence of the transfer sheet S. The signal from the cassette sheet existence sensor 39 is sent to the main control portion 25 via an input circuit 38. A size of the transfer sheet S is judged on the basis of a size of the sheet supply cassette 2, and the size of the sheet supply cassette 2 is detected by a cassette size sensor 41. A signal from the cassette size sensor 41, which represents the size of the sheet supply cassette 2, is sent to the main control portion 25 via an input circuit 40.

The sheet supply roller 5 is connected to a sheet supply clutch 37, engagement and disengagement of which is controlled by a driver 36 on the basis of a signal from the main control portion 25. The register rollers 6 are connected to a register roller clutch 43, engagement and disengagement of which is controlled by a driver 42 on the basis of a signal from the main control portion 25. The laser beam unit 14 is controlled by a laser drive circuit 32 on the basis of a signal from the main control portion 25, and the polygon mirror 15 is controlled by a polygon mirror drive circuit 30 on the basis of a signal from the main control portion 25.

The pre-exposure lamp 17 is driven by a driver 56 which determines an operation condition of the pre-exposure lamp 17 on the basis of a signal from the main control portion 25. The primary charger 18, developer 19 and transfer charger 20 are controlled by a high voltage transfer control circuit 57' which controls the primary charger 18, developer 19 and transfer charger 20 on the basis of signals from the main control portion 25. A remaining amount of toner in the developer 19 is detected by a toner remaining amount detector 48 which in turn outputs a detection signal representative of the toner remaining amount. The detection signal from the toner remaining amount detector 48 is sent to the main control portion 25 via a toner remaining amount detection circuit 47.

The energization and disenergization of the fixing heater 57 is effected by a fixing heater control circuit 58 on the basis of a signal from the main control portion 25. As shown in FIG. 4, the fixing heater control circuit 58 comprises a pulse-level transfer circuit 53, a phototriac coupler 54 incorporating a zerocross therein, and a bi-directional thyristor Q4. When a signal commanding the operation of the fixing heater 57 is sent from a PAI port of the main control portion 25 to the pulse-level transfer circuit 53 of the fixing heater control circuit 58, a transistor Q3, the phototriac coupler 54 and the bi-directional thyristor Q4 are turned ON, thereby starting the energization of the fixing heater 57. On the other hand, when a signal commanding the stop of the operation of the fixing heater 57 is sent from the PA1 port of the main control portion 25 to the pulse-level transfer circuit 53 of the fixing heater control circuit 58, the fixing heater 57 is disenergized.

A detection signal from the sheet discharge sensor 10 is sent to the main control portion 25 via an input circuit 46.

Next, the control of the operation of the fixing heater effected when the transfer sheets S in the sheet supply cassette 2 are used up or when the toner remaining amount befalls below an image formation permitting level will be explained with reference to FIG. 2.

Figure 2:
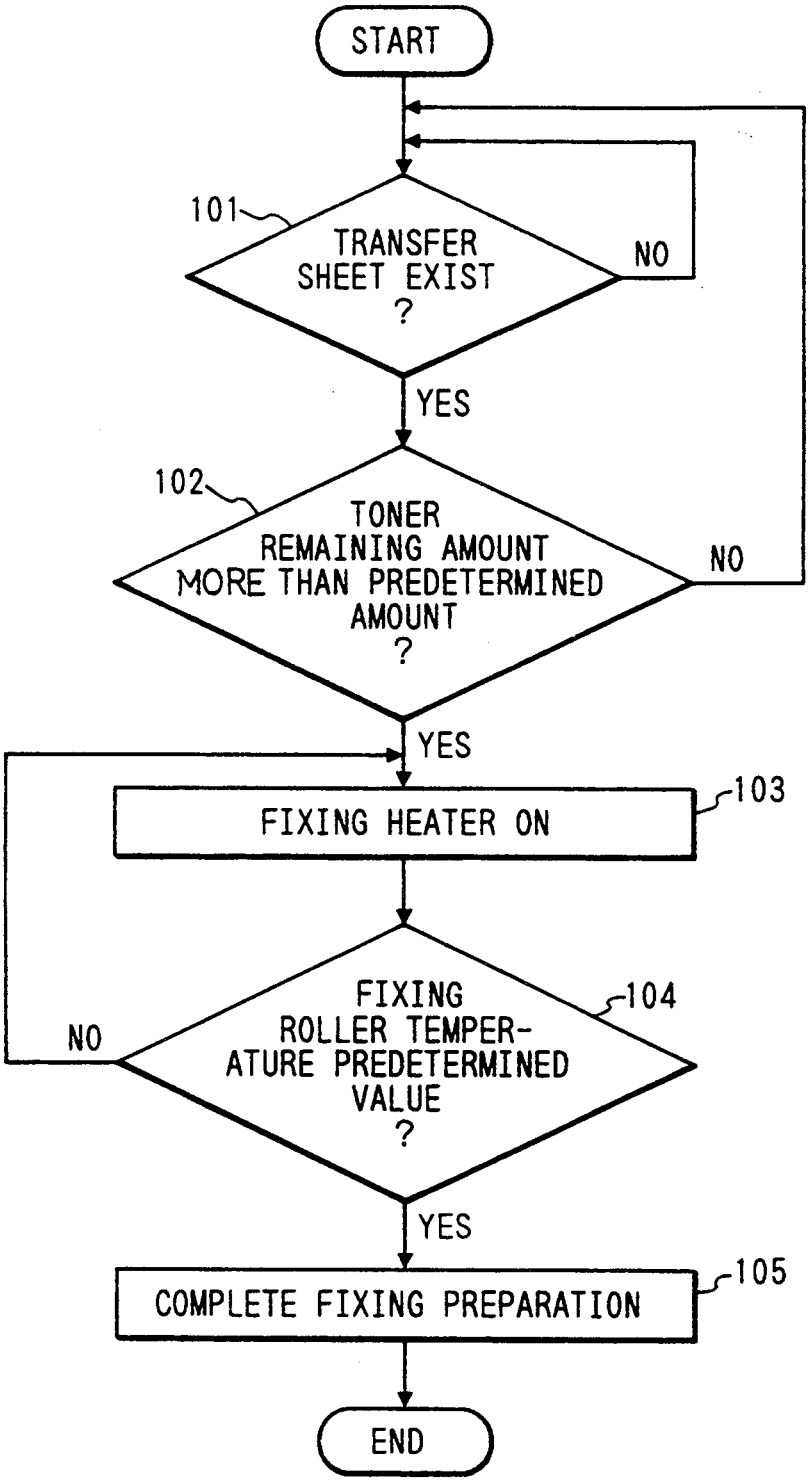
FIG. 2 is a flow chart according to a preferred embodiment.

As shown in FIG. 2, the main control portion 25 controls the operation of the fixing heater 57 while monitoring the presence/absence of the transfer sheet S and whether the toner remaining amount in the developer 19 is above or below the pre-selected value, after a main power source of the image forming apparatus is turned ON.

When the transfer sheets S are present in the sheet supply cassette 2 and the toner remaining amount in the developer 19 is above the pre-selected value, the cassette sheet existence sensor 39 generates a detection signal representative of the presence of the transfer sheet(s) S in the sheet supply cassette 2 on the basis of the shifting amount of the actuator 4, which detection signal is sent to the main control portion 25 via the input circuit 38 (step 101).

The toner remaining amount detection circuit 47 generates a detection signal representative of the fact that the toner remaining amount detected by the toner remaining amount detector 48 is greater than the pre-selected value, which detection signal is sent to the main control portion 25 (step 102).

The main control portion 25 generates a signal commanding the operation of the fixing heater 57, on the basis of the detection signal from the cassette sheet existence sensor 39 and the detection signal from the toner remaining amount detection circuit 47, which signal is sent to the fixing heater control circuit 58. The transistor Q3, phototriac coupler 54 and bi-directional thyristor Q4 of the fixing heater control circuit 58 are turned ON to start the energization of the fixing heater 57 (step 103).

The main control portion 25 monitors the surface temperature of the fixing roller 55, and stops the heating operation for the fixing roller 55 when the surface temperature of the fixing roller 55 reaches the predetermined fixing temperature (step 104). In this way, the fixing preparation condition of the fixing device 9 is completed, and the surface temperature of the fixing roller 55 is maintained to the predetermined value by repeating ON and OFF of the heating operation for the fixing heater 57 (step 105).

When the remaining number of the transfer sheets S becomes zero during the image forming operation (step 101), the cassette sheet existence sensor 39 generates a detection signal representative of the absence of the transfer sheet S in the sheet supply cassette 2 on the basis of the shifting amount of the actuator 4, which detection signal is sent to the main control portion 25 via the input circuit 38. The main control circuit 25 generates a signal commanding the stop of the heating operation for the fixing heater 57 on the basis of the detection signal from the cassette sheet existence sensor 39 and outputs such signal to the fixing heater control circuit 58 which in turn deenergizes the fixing heater 57.

Similarly, when the toner remaining amount in the developer 19 is decreased below the predetermined value (step 102), the toner remaining amount detection circuit 47 sends to the main control portion 25 a signal representative of the fact that the toner remaining amount is below the pre-selected value. Then, the main control portion 25 generates the signal commanding the stop of the heating operation for the fixing heater 57 on the basis of the detection signal from the toner remaining amount detection circuit 47 and outputs such signal to the fixing heater control circuit 58 which in turn deenergizes the fixing heater 57.

When the remaining number of the transfer sheets S in the sheet supply cassette 2 becomes zero, the operator removes the sheet supply cassette from the body, and re-insets the cassette into the body after new transfer sheets are loaded in the cassette. When the sensor 39 detects the presence of the transfer sheet(s) in the cassette, the energization of the fixing heater 57 is started again.

Similarly, when the toner remaining amount falls below the predetermined value, the operator replenishes toner in the developer. When the toner remaining amount detection circuit 47 detects the fact that the toner remaining amount exceeds the predetermined value, the energization of the fixing heater 57 is started again.

As mentioned above, according to the present invention, it is possible to prevent the shock or vibration generated by the loading of new transfer sheets or the replenishment of new toner from acting on the image forming apparatus, thereby extending the service life of the heater.

While the present invention was explained in connection with the particular embodiment, it should be noted that the present invention is not limited to such embodiment and various alterations can be effected without departing from the scope of the present invention.

What is claimed is:

1. An image forming apparatus comprising:

a sheet supply cassette for holding a plurality of recording members therein, said cassette removably mounted within the image forming apparatus;

image forming means for forming a non-fixed image on the recording member supplied from said sheet supply cassette;

fixing means having a heater for thermally fixing the non-fixed image on the recording member;

remaining amount detection means for detecting a remaining amount of recording members in said sheet supply cassette; and energization stopping means for stopping energization of said heater on the basis of a detection signal from said remaining amount detection means.

2. An image forming apparatus according to claim 1, wherein said remaining amount detection means detects absence of the recording member in said sheet supply cassette.

3. An image forming apparatus according to claim 1, wherein said heater is a halogen heater.

4. An image forming apparatus, comprising:

image forming means for forming a toner image on a recording member;

fixing means having a heater for thermally fixing the image on the recording member;

remaining amount detection means for detecting a remaining amount of toner; and energization stopping means for stopping energization of said heater based on a detection signal from said remaining amount detection means.

5. An image forming apparatus according to claim 4, wherein said image .forming means has a containing portion for containing the toner, and wherein said remaining amount detection means detects remaining amount of the toner in said containing portion.

6. An image forming apparatus according to claim 5, wherein said image forming means has an image bearing member for bearing a latent image and a developing device for developing the latent image with toner, and wherein said containing portion is provided in said developing device.

7. An image forming apparatus according to claim 4, wherein said heater is a halogen heater.

* * * * *

UNITED STATES PATENT AND TRADEMARK OFFICE

CERTIFICATE OF CORRECTION

PATENT NO. : 5,359,400
DATED : October 25, 1994
INVENTOR(S) : TOSHIYUKI ITOH, ET AL.

It is certified that error appears in the above-indentified patent and that said Letters Patent is hereby corrected as shown below:

Column [57] ABSTRACT:
line 8, "detecter" should read --detector--; and
line 9, "means" should be deleted.

Column 2:
line 32, "Fig. 1." should read --FIG. 1.--.

Column 4:
line 12, "PA1" should read --PAI--; and
line 22, "befalls" should read --falls--.

Column 5:
line 27, "re-insets" should read --re-inserts--.

Column 6:
line 36, ".forming" should read --forming--; and
line 38, "detects" should read --detects the--.

Signed and Sealed this

Eleventh Day of April, 1995

Bruce Lehman

*Attest:*

BRUCE LEHMAN

*Attesting Officer*

*Commissioner of Patents and Trademarks*